US010937349B2

(12) United States Patent
Yamazaki et al.

(10) Patent No.: US 10,937,349 B2
(45) Date of Patent: Mar. 2, 2021

(54) DISPLAY DEVICE WITH GRADIENT CONVERSION

(71) Applicant: SHENZHEN TOREY MICROELECTRONIC TECHNOLOGY CO. LTD., Shenzhen (CN)

(72) Inventors: Hiroyuki Yamazaki, Sakai (JP); Kazuhiro Nagasawa, Sakai (JP)

(73) Assignee: SHENZHEN TOREY MICROELECTRONIC TECHNOLOGY CO. LTD., Shenzhen (CN)

( * ) Notice: Subject to any disclaimer, the term of this patent is extended or adjusted under 35 U.S.C. 154(b) by 0 days.

(21) Appl. No.: 16/433,962

(22) Filed: Jun. 6, 2019

(65) Prior Publication Data

US 2019/0385502 A1 Dec. 19, 2019

Related U.S. Application Data

(60) Provisional application No. 62/684,604, filed on Jun. 13, 2018.

(51) Int. Cl.
*G09G 3/20* (2006.01)

(52) U.S. Cl.
CPC ..... *G09G 3/20* (2013.01); *G09G 2310/027* (2013.01); *G09G 2310/0297* (2013.01); *G09G 2330/028* (2013.01)

(58) Field of Classification Search
CPC combination set(s) only.
See application file for complete search history.

(56) References Cited

U.S. PATENT DOCUMENTS

2010/0182348 A1* 7/2010 Okutani ..... G09G 3/3688 345/690

FOREIGN PATENT DOCUMENTS

JP 2015-114399 A 6/2015

* cited by examiner

*Primary Examiner* — Lisa S Landis
(74) *Attorney, Agent, or Firm* — ScienBiziP, P.C.

(57) ABSTRACT

[Object] To realize a drive circuit where settling time (stabilization time) is shortened, without incurring marked increase in electric current consumed and marked increase in manufacturing costs.

[Solution] A source drive circuit (1) has a digital gradient input converter (2) that converts gradient values of multiple image data (D1 through Dn) that are gradient 1 into multiple gradient values, where the number of the multiple source amps (AM1 through AMn) to which a gradient reference voltage (V1) corresponding to gradient 1 is supplied, is reduced, and supplied to a DAC circuit (23).

11 Claims, 10 Drawing Sheets

| | | |
|---|---|---|
| 1: SOURCE DRIVE CIRCUIT | 23: DAC CIRCUIT | 25: DEMULTIPLEXER |
| 2: DIGITAL GRADIENT INPUT CONVERTER | 24: GAMMA CIRCUIT | |

| | |
|---|---|
| 1: SOURCE DRIVE CIRCUIT | 10: DISPLAY DEVICE |
| 3: GATE DRIVE CIRCUIT | G1, G2, Gm: GATE LINES |
| 4: DISPLAY PANEL | S1, Sr: SOURCE LINES |

DISPLAY DEVICE WITH GRADIENT CONVERSION

TECHNICAL FIELD

The present invention relates to a drive circuit that drives a display panel, and a display device having the drive circuit.

BACKGROUND ART

There is need for even faster output delay in display driver ICs (drive circuits) for liquid crystal display panels, organic EL (Electro Luminescence: electroluminescence) panels having OLED (Organic Light Emitting Diode: organic light-emitting diode), and so forth, due to high definition, handling double-speed driving, and so forth, of panels in recent years.

FIG. 7 is a diagram illustrating a conventional source drive circuit that performs multiplexed driving where multiple (e.g., 18) source lines are driven by time division.

As illustrated in (a) in FIG. 7, the conventional source drive circuit includes multiple source amps AM1 through AM171, a gamma circuit 24 that outputs gradient reference voltages V0 through V255, a DAC circuit 23 that selects one from a 256 count of gradient reference voltages V0 through V255 supplied via each of a 256 count of respective reference power source bus lines from the gamma circuit 24, based on each of gradient values of input image data D1 through D171, and supplies to each of multiple source amps AM1 through AM171, and a demultiplexer 25 that distributes voltages output from respective output nodes Q1 through Q171 of the multiple source amps AM1 through AM171 to source lines S1 through S3078 by time division based on voltage select signals SEL1 through SEL18.

(b) in FIG. 7 illustrates a configuration example of the DAC circuit 23 and gamma circuit 24. The gamma circuit 24 disposed on both the right and left side of the DAC circuit 23 includes resistor elements RA1 through RA257 and resistor elements RB1 through RB257 that divide between high-potential side voltage VH and low-potential side voltage VL. Nodes between the resistor elements RA1 through RA257 and nodes between the resistor elements RB1 through RB257 are connected to common reference power source bus lines BL1 through BL256. Gradient reference voltages V0 through V255 are output to each of the reference power source bus lines BL1 through BL256.

The DAC circuit 23 has switch elements S1-1 through S171-256 connected between each of the multiple source amps AM1 through AM171, and each of the reference power source bus lines BL1 through BL256. On and off control of the switch elements S1-1 through S171-256 is controlled based on each gradient value of the image data D1 through D171. For example, in a case where the image data D171 is gradient 127 (equivalent to gradient reference voltage V127), only the switch element S171-128 is on out of the switch elements S1-1 through S171-256, the other switch elements S171-1 through S171-127 and S171-129 through S171-256 are off, and the gradient reference voltage V127 is supplied to an input node U171 of the source amp AM171.

FIG. 8 is a diagram for describing problems with the conventional source drive circuit illustrated in FIG. 7.

FIG. 9 is a diagram for describing a case where the above problem becomes markedly pronounced in the conventional source drive circuit.

In the case of the conventional source drive circuit 100 illustrated in FIG. 9 for example, in a case where all of each of the gradient values of image data D1 through Dn are gradient 1 (equivalent to gradient reference voltage V1) for example, all of the input nodes U1 through Un of the n count of source amps AM1 through AMn are electrically connected to reference power source bus line BL2 where the gradient reference voltage V1 is output.

(a) in FIG. 8 is a diagram illustrating a schematic configuration of source amp AMn, where the input node Un and output node Qn of the source amp AMn are connected to the gates of an input transistor Mp and output transistor Mm that are transistors in the source amp AMn, and gate capacitance of the input transistor Mp (indicated by dotted line in the drawing) and gate capacitance of the output transistor Mm (indicated by dotted line in the drawing) are formed. In a case where all of the input nodes U1 through Un of the n source amps AM1 through AMn are electrically connected to one of the reference power source bus lines BL1 through BL256 (reference power source bus line BL2 in the case of FIG. 9) that outputs one of the gradient reference voltages V0 through V255 as illustrated in FIG. 9, the load on a particular reference power source bus line (reference power source bus line BL2 in the case of FIG. 9) increases due to the effects of the gate capacitance. That is to say, the greater the number is of input nodes U1 through Un of the source amps AM1 through AMn electrically connected to a certain one of the reference power source bus lines BL1 through BL256, the greater the load on the certain one of the reference power source bus lines BL1 through BL256. Also, the greater the difference between the gradient value of the image data D1 through Dn input the previous time and the gradient value of the image data D1 through Dn input this time is, such as in a case of each of the image data D1 through Dn changing from gradient 0 (equivalent to gradient reference voltage V0) to gradient 255 (equivalent to gradient reference voltage V255), the greater the load on the certain one of the reference power source bus lines BL1 through BL256.

(b) in FIG. 8 is a diagram illustrating change in the output of a certain reference power source bus line BL256 due to effects of the gate capacitance in a case where the load on the reference power source bus line BL256 is greatest. As illustrated in (b) in FIG. 8, when each of the image data D1 through Dn changes from gradient 0 to gradient 255, the output of the reference power source bus line BL256 rises in the V0 direction that is the arrow direction in the drawing due to movement of the charge accumulated in the gate capacitance (in a case where V0>V255 as illustrated in (b) in FIG. 7). That is to say, when each of the image data D1 through Dn changes from gradient 0 to gradient 255, the output of the reference power source bus line BL256 becomes higher voltage than the expected value of V255. Note that this amount of rise becomes greater the greater the number of input nodes U1 through Un of the source amps AM1 through AMn electrically connected to a certain reference power source bus line BL1 through BL256 becomes.

(c) in FIG. 8 is a diagram illustrating source output at the respective output nodes Qn of the multiple source amps AMn electrically connected to the reference power source bus line BL256 in a case where a rise has occurred in the output of the reference power source bus line BL256, as illustrated in (b) in FIG. 8. When each of the image data D1 through Dn change from gradient 0 to gradient 255, the time it takes for stabilization of the source output from a V0 expected value equivalent to the gradient 0 to near a V255 expected value equivalent to the gradient 255 (settling time) increases due to the effects of the above-described rise, as illustrated in (c) in FIG. 8. This is problematic in a display device that has a source drive circuit with a large settling time, since there are cases where insufficient gradients in display, display noise, uneven display, and so forth, are visually recognizable.

Accordingly, PTL 1 discloses a configuration where the number of gamma circuits 24*a*, 24*b*, and 24*c* that output the gradient reference voltage V0 through V255, and in conjunction with this, the number of reference power source bus lines is also increased.

FIG. 10 is a diagram illustrating a schematic configuration of the source drive circuit disclosed in PTL 1. This source drive circuit has three gamma circuits that output gradient reference voltage V0 through V255, namely, a first gamma circuit 24*a*, a second gamma circuit 24*b*, and a third gamma circuit 24*c*, and in conjunction with this increase in gamma circuits, includes a DAC circuit 23*a* of a configuration that has an increased number of reference power source bus lines, multiple source amps AM1 through AM171, and a demultiplexer 25*a* that distributes voltages output from the respective output nodes Q1 through Q171 of the multiple source amps AM1 through AM171 to the source lines S1 through S3078 in time division based on voltage select signals SEL1 through SEL18.

CITATION LIST

Patent Literature

[PTL 1] Japanese Unexamined Patent Application Publication No. 2015-111399 (Disclosed Jun. 22, 2015)

SUMMARY OF INVENTION

Technical Problem

However, in a case of a configuration where the number of gamma circuits 24*a*, 24*b*, 24*c* is greatly increased, and the number of reference power source bus lines also is greatly increased, as in the source drive circuit disclosed in PTL 1 illustrated in FIG. 10, the following problems occur.

Greatly increasing the number of gamma circuits 24*a*, 24*b*, 24*c* markedly increased electric current consumed, and also greatly increasing the number of gamma circuits 24*a*, 24*b*, 24*c* and the number of reference power source bus lines markedly increases the chip size of the source drive circuit, leading to a problem of marked increase in manufacturing costs.

Particularly, in a configuration where the number of the gamma circuits 24*a*, 24*b*, 24*c* is increased, as with the source drive circuit disclosed in PTL 1 illustrated in FIG. 10, the number of reference power source bus lines markedly increases in a case of changing the gradients from 256 gradients to 512 gradients or 1024 gradients.

An aspect of the present invention has been made in light of the above problem, and it is an object thereof to realize a drive circuit where settling time (stabilization time) is shortened, and a display device where insufficient gradients in display, display noise, uneven display, and so forth, are suppressed.

Solution to Problem (1) An embodiment of the present invention is a drive circuit including: a plurality of source amps; a gradient reference voltage generating circuit that generates M (where M is a natural number of 2 or greater) different gradient reference voltages; and a digital/analog conversion circuit that selects one of the M gradient reference voltages supplied from the gradient reference voltage generating circuit via each of M bus lines, based on each of input gradient values, and supplies to each of the plurality of source amps. A gradient input converter is provided that converts the plurality of gradient values of a plurality of image data that are the same value into a plurality of gradient values, where the number of the plurality of source amps to which a gradient reference voltage corresponding to the plurality of gradient values that are the same value is supplied, is reduced, and supplies to the digital/analog conversion circuit.

According to this configuration, a drive circuit where settling time (stabilization time) is shortened without incurring marked increase in electric current consumed and marked increase in manufacturing costs can be realized.

(2) Also, an embodiment of the present invention is a drive circuit where, in addition to the configuration of (1) above, the gradient input converter converts at least part of the plurality of gradient values of a plurality of image data that are the same value to a gradient value that is one higher or a gradient value that is one lower.

(3) Also, an embodiment of the present invention is a drive circuit where, in addition to the configuration of (1) above or (2) above, the gradient input converter performs the conversion only in a first case where the plurality of gradient values of a plurality of image data that are the same value are a gradient value that is N (where N is a natural number of 1 or greater and 3 and smaller) below a greatest gradient value or greater, or the greatest gradient value or smaller, and in a second case where the plurality of gradient values of a plurality of image data that are the same value are a gradient value that is the smallest gradient value or greater, or N above a smallest gradient value or smaller.

(4) Also, an embodiment of the present invention is a drive circuit where, in addition to the configuration of (1) above or (2) above, the gradient input converter only performs the conversion in a case where a difference between the plurality of gradient values of a plurality of image data that are the same value and a plurality of gradient values of a plurality of image data supplied immediately prior is a predetermined value or greater.

(5) Also, an embodiment of the present invention is a drive circuit where, in addition to the configuration of any one of (1) above through (4) above, an adjustment value for deciding a magnitude of conversion of the plurality of gradient values of a plurality of image data that are the same value is set in each of the plurality of source amps at the gradient input converter, and in a case where a value obtained by adding the adjustment value and the plurality of gradient values of a plurality of image data that are the same value is the smallest gradient value or greater and the greatest gradient value or smaller, each of the plurality of gradient values of a plurality of image data that are the same value is converted by an amount corresponding to the adjustment value.

(6) Also, an embodiment of the present invention is a drive circuit where, in addition to the configuration of any-one of (1) above through (4) above, the gradient input converter has a plurality of registers, an adjustment value for deciding the magnitude of conversion of the plurality of gradient values of a plurality of image data that are the same value is set by each of the setting values of the plurality of registers, and in a case where a value obtained by adding the adjustment value and the plurality of gradient values of a plurality of image data that are the same value is the smallest gradient value or greater and the greatest gradient value or smaller, each of the plurality of gradient values of a plurality of image data that are the same value is converted by an amount corresponding to the adjustment value.

(7) Also, an embodiment of the present invention is a drive circuit where, in addition to the configuration of any one of (1) above through (4) above, the gradient input converter has a random number generator, an adjustment value for deciding the magnitude of conversion of the plurality of gradient values of a plurality of image data that are the same value is set by a random number generated by the random number generator, and in a case where a value obtained by adding the adjustment value and the plurality of gradient values of a plurality of image data that are the same value is the smallest gradient value or greater and the greatest gradient value or smaller, each of the plurality of gradient values of a plurality of image data that are the same value is converted by an amount corresponding to the adjustment value.

(8) Also, an embodiment of the present invention is a drive circuit where, in addition to the configuration of any one of (1) above through (4) above, an adjustment value for deciding the magnitude of conversion of the plurality of gradient values of a plurality of image data that are the same value is set by the gradient input converter performing dithering processing on each pixel region of a predetermined size configured of part of the plurality of pixels that display the plurality of image data, and in a case where a value obtained by adding the adjustment value and the plurality of gradient values of a plurality of image data that are the same value is the smallest gradient value or greater and the greatest gradient value or smaller, each of the plurality of gradient values of a plurality of image data that are the same value is converted by an amount corresponding to the adjustment value.

(9) Also, an embodiment of the present invention is a drive circuit where, in addition to the configuration of (8) above, the dithering processing includes first dithering processing that is dithering processing performed on image data of odd frames in the plurality of image data, and second dithering processing that is dithering processing performed on image data of even frames in the plurality of image data, the first dithering processing and the second dithering processing being different.

(10) Also, an embodiment of the present invention is a drive circuit where, in addition to the configuration of any one of (5) above through (9) above, at the gradient input converter, in a case where a value obtained by adding the adjustment value and the plurality of gradient values of a plurality of image data that are the same value is smaller than the smallest gradient value or greater than the greatest gradient value, each of the plurality of gradient values of a plurality of image data that are the same value is output without change, without being converted by an amount corresponding to the adjustment value.

(11) Also, an embodiment of the present invention is a drive circuit where, in addition to the configuration of any one of (5) above through (9) above, at the gradient input converter, in a case where a value obtained by adding the adjustment value and the plurality of gradient values of a plurality of image data that are the same value is smaller than the smallest gradient value, the smallest gradient value is output, and in a case where a value obtained by adding the adjustment value and the plurality of gradient values of a plurality of image data that are the same value is greater than the greatest gradient value, the greatest gradient value is output.

(12) Also, an embodiment of the present invention is a display device including, in addition to the drive circuit according to any one of (1) above through (11) above, and a display panel.

According to the above configuration, a display device where insufficient gradients in display, display noise, uneven display, and so forth, are suppressed, can be realized.

Advantageous Effects of Invention

A drive circuit where settling time (stabilization time) is shortened without incurring marked increase in electric current consumed and marked increase in manufacturing costs, and a display device where insufficient gradients in display, display noise, uneven display, and so forth, are suppressed, can be realized.

DESCRIPTION OF EMBODIMENTS

Embodiments of the present invention will be described below with reference to FIG. 1 through FIG. 6. Hereinafter, configuration that have the same functions as a configuration described in a particular embodiment may be denoted by the same symbols, and description thereof omitted, for the sake of convenience in description.

First Embodiment

A first embodiment of the present invention will be described below with reference to FIG. 1 and FIG. 2.

(Source Drive Circuit 1)

Figure 1:
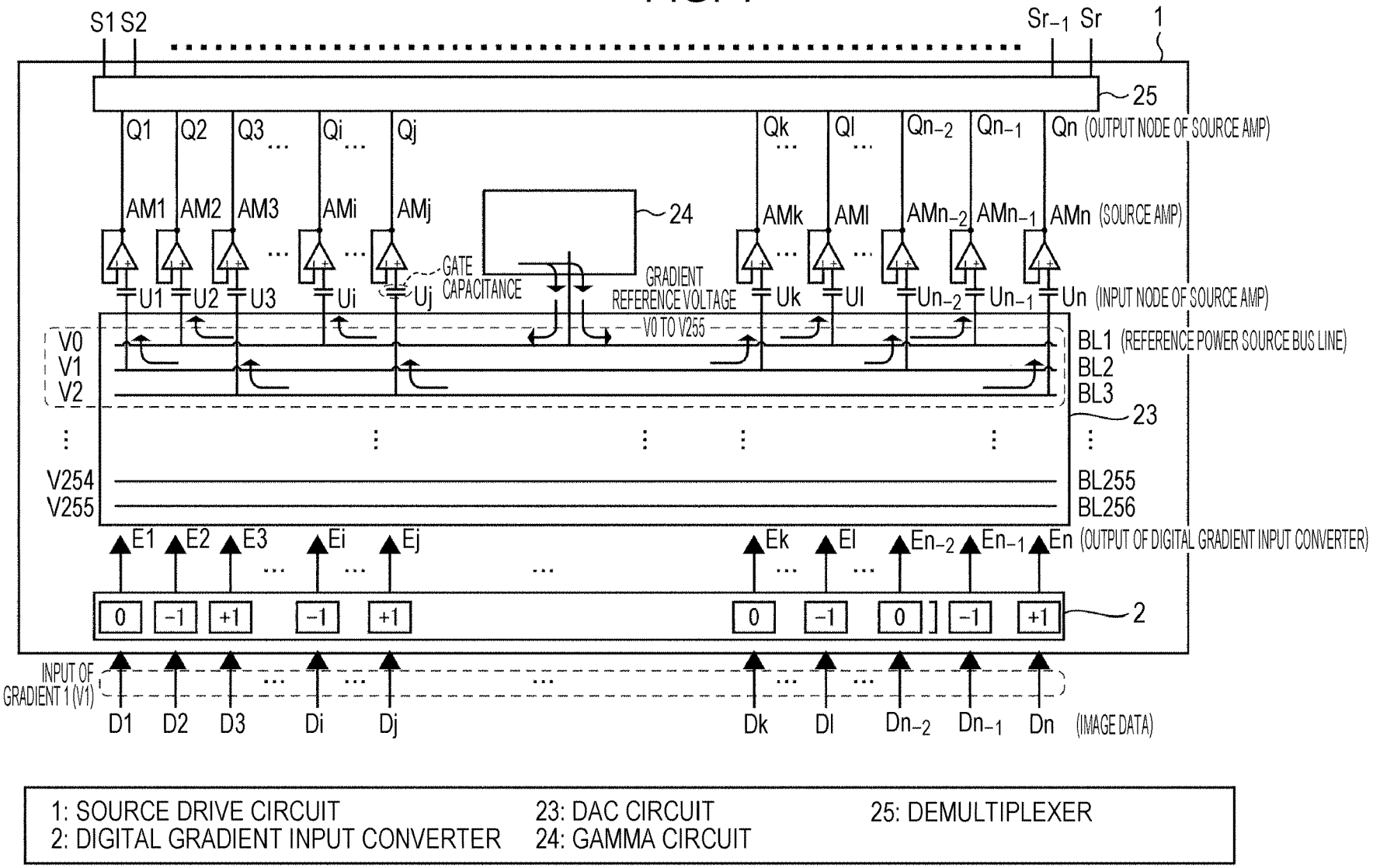
FIG. 1 is a diagram illustrating the overall configuration of a source drive circuit according to a first embodiment of the present invention.

FIG. 1 is a diagram illustrating the overall configuration of a source drive circuit 1 according to the first embodiment of the present invention.

It can be seen from FIG. 1 that the source drive circuit 1 (drive circuit) includes a digital gradient input converter 2 (gradient input converter), multiple source amps AM1 through AMn, a gamma circuit 24 that outputs gradient reference voltages V0 through V255, a DAC circuit 23 that selects one of a 256 count of gradient reference voltages V0 through V255 supplied via a 256 count of reference power source bus lines BL1 through BL256 from the gamma circuit 24 based on each of gradient values from input image data D1 through Dn, and supplies to each of the multiple source amps AM1 through AMn, and a demultiplexer 25 that distributes voltage output from each of output nodes Q1 through Qn of the multiple source amps AM1 through AMn to source lines S1 through Sr, in time division based on select signals SEL1 through SEL18. The i, j, k, l, n, and r in the drawing are natural numbers, satisfying the relation of $i<j<k<l<n<r$.

Figure 7:
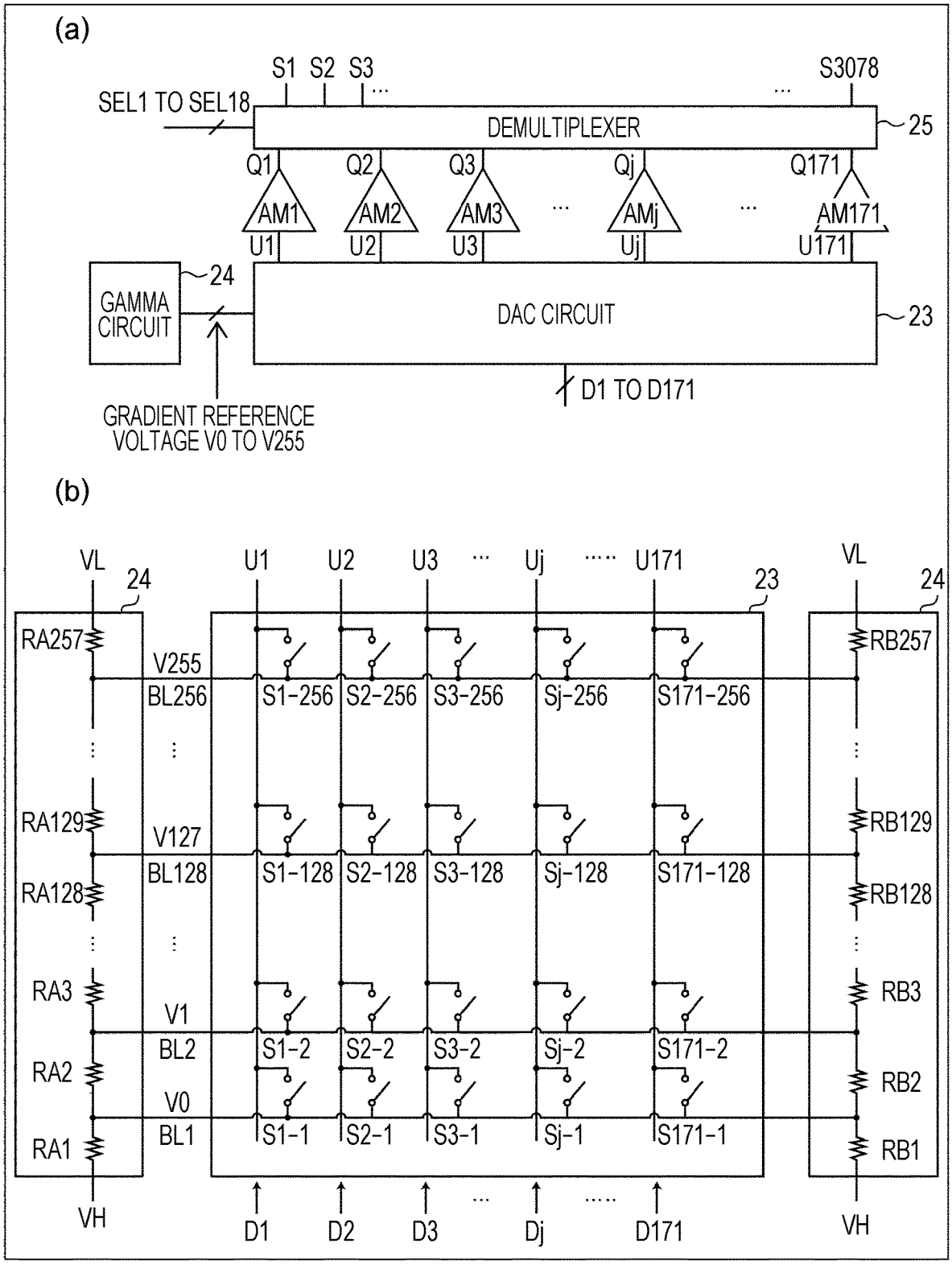
FIG. 7 is a diagram illustrating a conventional source drive circuit that performs multiplexed driving where multiple source lines are driven by time division.
Figure 8:
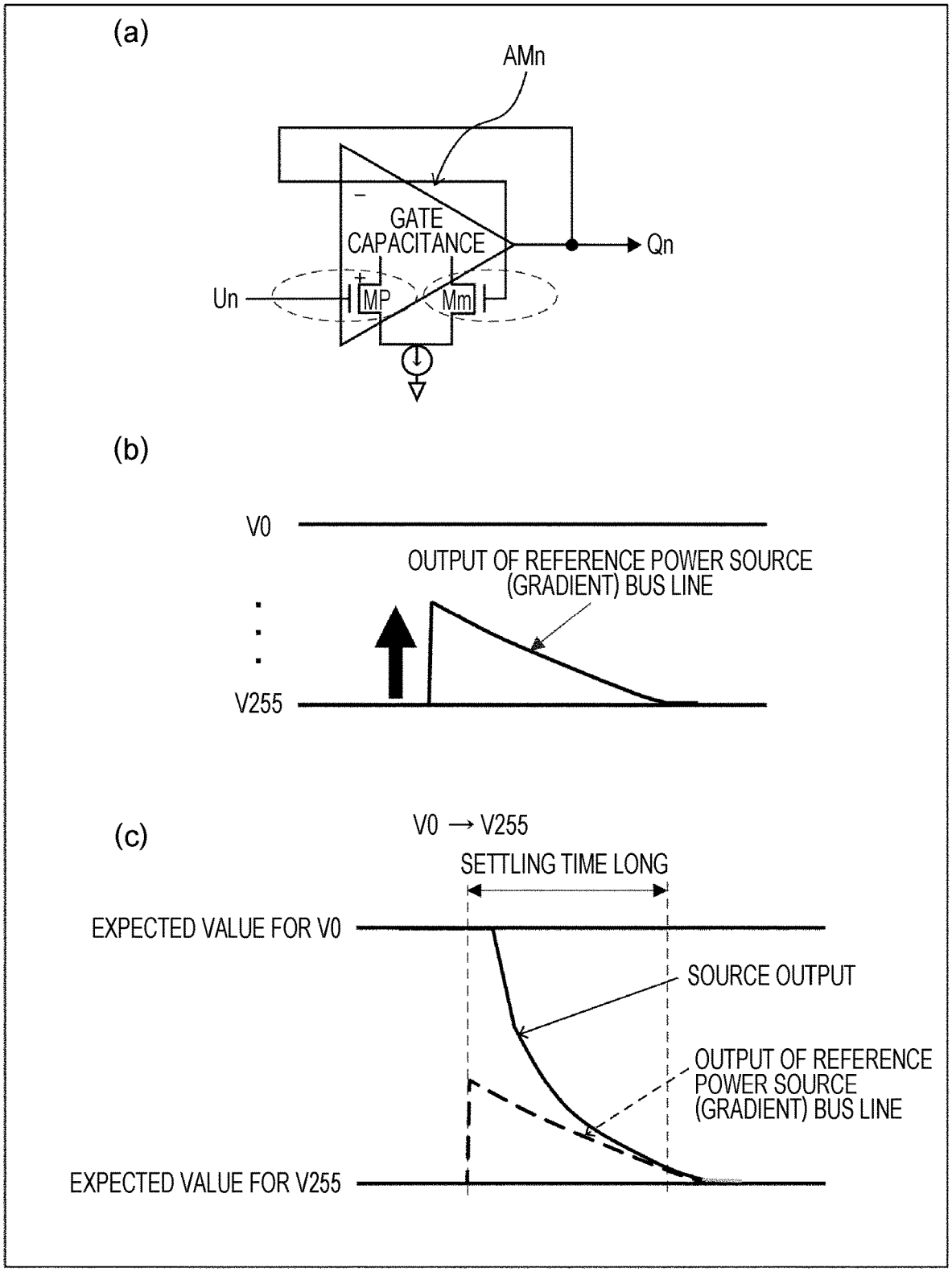
FIG. 8 is a diagram for describing problems of the conventional source drive circuit illustrated in FIG. 7.
Figure 9:
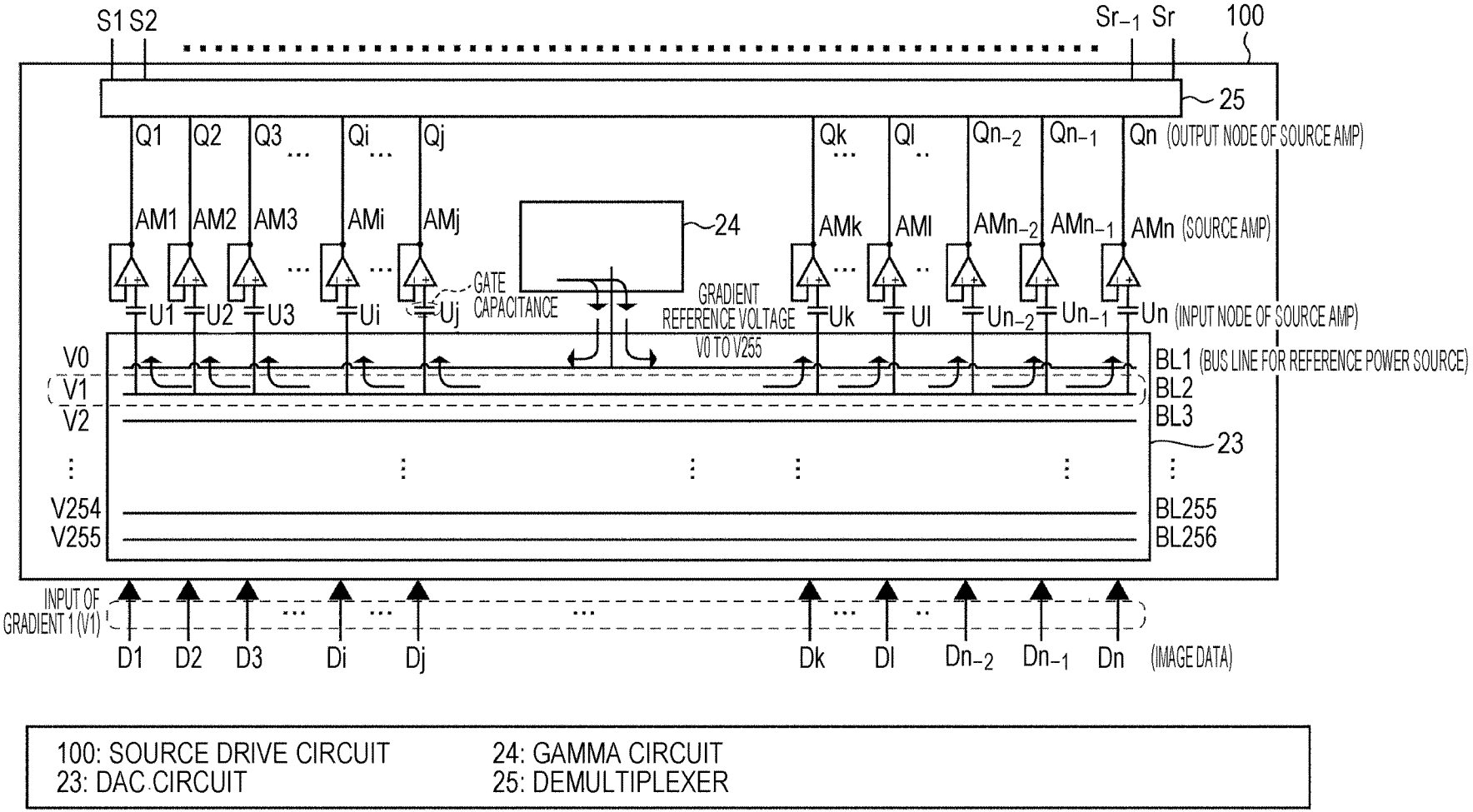
FIG. 9 is a diagram for describing a case where the problem becomes markedly pronounced in the conventional source drive circuit.
Figure 10:
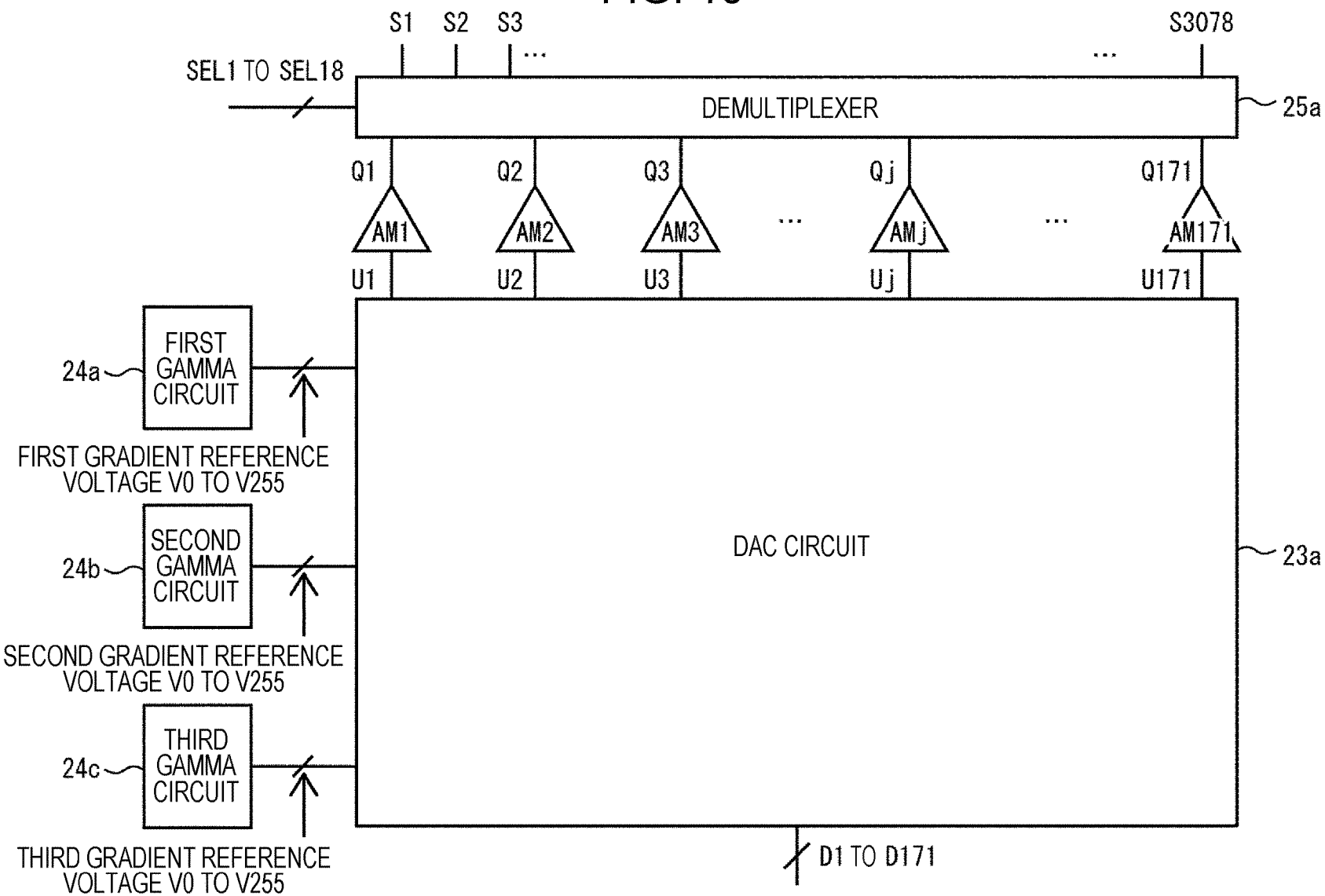
FIG. 10 is a diagram illustrating a schematic configuration of a conventional source drive circuit disclosed in PTL 1.

Note that the multiple source amps AM1 through AMn, the DAC circuit 23, the gamma circuit 24, and the demultiplexer 25 are of the same configuration as the configuration provided to the conventional source drive circuit illustrated in FIG. 7, and the configurations thereof have already been described above, so description here will be omitted, and the digital gradient input converter 2 along will be described.

Although the source drive circuit 1 including the demultiplexer 25 is described as one example in the present embodiment, but it is needless to say that the present invention is applicable to a source drive circuit that does not have the demultiplexer 25.

(About Configuration of Digital Gradient Input Converter 2)

In a case of the conventional source drive circuit that does not have the digital gradient input converter 2, and in a case where all of each of the gradient values of image data D1 through Dn are gradient 1 (equivalent to gradient reference voltage V1) for example, all of the input nodes U1 through Un of the n count of source amps AM1 through AMn are electrically connected to reference power source bus line BL2 where the gradient reference voltage V1 is output, so the load on the reference power source bus line BL2 is great. Accordingly, a source drive circuit where the settling time (stabilization time) is short cannot be realized.

On the other hand, the source drive circuit 1 according to the present embodiment has the digital gradient input converter 2 that converts the multiple gradient values ox the multiple image data D1 through Dn that are of the same value (in the case in FIG. 1, gradient 1 (equivalent to gradient reference voltage V1)) into multiple gradient values, where the number of the multiple source amps AM1 through AMn to which the gradient reference value (in the case in FIG. 1, gradient reference voltage V1) corresponding to the multiple gradient values that are the same value is supplied, is reduced, and supplied to the DAC circuit 23.

Although an example will be described in the present embodiment of a case where, at the digital gradient input converter 2, adjustment values that decide the magnitude of conversion of the multiple gradient values of the multiple image data D1 through Dn are set as 0, −1, +1, . . . in order from the left edge in the drawing, and the adjustment values for each of the multiple source amps AM1 through AMn corresponding to each of the multiple image data D1 through Dn are fixed, but this is not restrictive. Note however, that in a case where the gradient value of the image data D1 through Dn is gradient 0 that is the smallest gradient value, there is need for settings where 0 or +1, that is other than −1, is set so as to be applied as an adjustment value, and in a case where gradient value of the image data D1 through Dn is gradient 255 that is the largest gradient value, there is need for settings where 0 or −1, that is other than +1, is set so as to be applied as an adjustment value. Accordingly, in the digital gradient input converter 2, the adjustment values for each of the multiple source amps AM1 through AMn corresponding to the multiple image data D1 through Dn are fixed in a case where the gradient values of the image data D1 through Dn input to the digital gradient input converter 2 are other than the smallest gradient value (gradient 0) and the greatest gradient value (gradient 255), i.e., gradient 1 through gradient 254. Note that the above adjustment values are an example and are not restrictive, and the order, magnitude, and so forth of adjustment value can be set as appropriate. Although an example is described in the present embodiment as a case where 0, −1, and +1 are applied to gradient values of the image data D1 through Dn input to the digital gradient input converter 2 as adjustment values and converted to a gradient value that is one hither or a gradient value that is one lower, this is not restrictive, and the magnitude of adjustment values can be set as appropriate, so as to convert to a gradient value one higher or a gradient value one lower.

Specifically, the output E1 through En of the digital gradient input converter 2 is output E1=gradient 1 (equivalent to gradient reference voltage V1), output E2=gradient 0 (equivalent to gradient reference voltage V0), output E3=gradient 2 (equivalent to gradient reference voltage V2) . . . output En−2=gradient 1 (equivalent to gradient reference voltage V1), output En−1=gradient 0 (equivalent to gradient reference voltage V0), and output En=gradient 2 (equivalent to gradient reference voltage V2).

Thus, the digital gradient input converter 2 can reduce the number of source amps AM1 through AMn electrically connected to the reference power source bus line BL2 where the gradient reference voltage V1 is output, by performing fixed computation (+1 or −1) on image data D2, D3, . . . Dn−1, Dn decided beforehand out of the input multiple image data D1 through Dn. Accordingly, the load on reference power source bus line BL2 can be suppressed from becoming great, and a source drive circuit 1 with short settling time (stabilization time) can be realized.

In the case of the digital gradient input converter 2, the range of adjustment values is −1 to +1 which is relatively small, and is a level of converting the gradient values of the image data D1 through Dn to one gradient value higher or one gradient value lower, so deterioration in image quality is not great. Accordingly, an example has been described in the present embodiment regarding a case where a decided adjustment value is always applied to each of all image data D1 through Dn regardless of the type of image data D1 through Dn, but this is not restrictive.

Note that an arrangement may be made in order to suppress deterioration of image quality due to conversion of gradient values at the digital gradient input converter 2, where decided adjustment values are applied only in a case where the gradient values of the image data D1 through Dn input to the digital gradient input converter 2 are in a particular range. For example, an arrangement may be made where adjustment values are applied only in a case where the gradient values of the image data D1 through Dn input to the digital gradient input converter 2 are in a particular range where difference in gradient change over time might be great. For example, adjustment values may be applied only in a case where the gradient values are in a particular range such as, if expressed in eight bits, several gradients from gradient 0 (e.g., gradient 0, gradient 1, and gradient 2, if three gradients from the bottom), and several gradients from gradient 255 (e.g., gradient 255, gradient 254, and gradient 253, if three gradients from the top).

Thus, in a case of having a configuration where adjustment values are applied only in a case where the gradient values of the image data D1 through Dn input to the digital gradient input converter 2 are in a particular range, a separate determining circuit that is omitted from illustration needs to be provided.

For example, a determining circuit for gradient 0, gradient 1, gradient 2, gradient 253, gradient 254, and gradient 255 (top/bottom three gradients) can be made having a configuration of comparing the higher order six bits of the input image data D1 through Dn with "000000" and "111111", whereby the input image data D1 through Dn having gradient values that are the top/bottom three gradients can be easily determined.

Note that in the present embodiment, application of adjustment values decided for each of the image data D1 through Dn is performed using a lookup table that is omitted from illustration. When setting the aforementioned lookup table, consideration needs to be given so that adjustment values are not applied in a case where the gradient values of the image data D1 through Dn are near gradient 0 which is near the smallest gradient value, since this would result in underflow of gradient values, and so that adjustment values are not applied in a case where the gradient values of the image data D1 through Dn are near gradient 255 which is near the greatest gradient value, since this would result in overflow of gradient values.

Although an example has been described in the present embodiment regarding a case where the gradients of the image data D1 through Dn are 256 gradients, this is not restrictive, and the gradients of the image data D1 through Dn may be 512 gradients, 1024 gradients, or the like, for example.

(Display Device 10)

Figure 2:
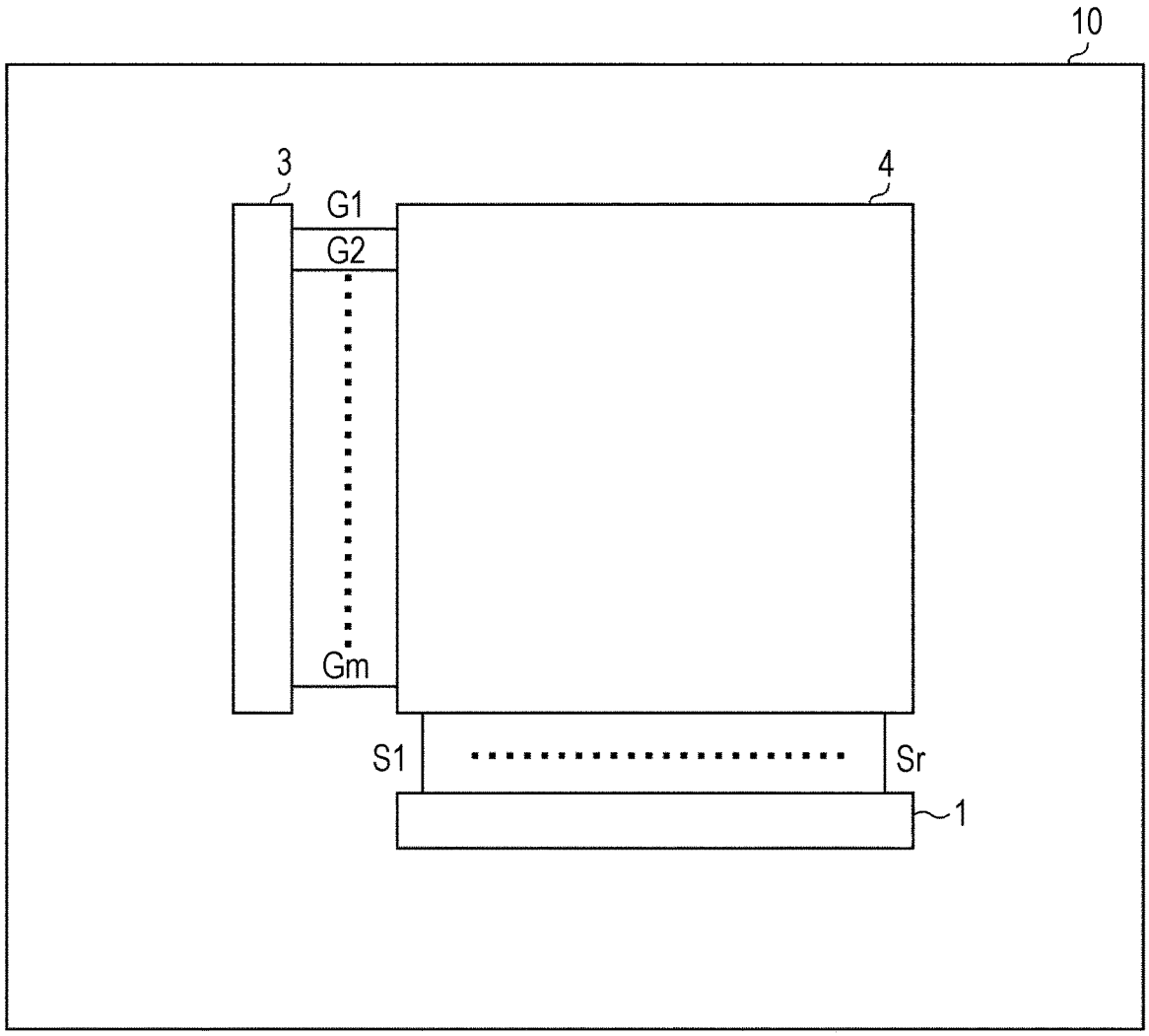
FIG. 2 is a diagram illustrating the overall configuration of a display device having the source drive circuit illustrated in FIG. 1.

FIG. 2 is a diagram illustrating the overall configuration of a display device 10 including the source drive circuit 1 illustrated in FIG. 1.

The display device 10 includes the source drive circuit 1, a gate drive circuit 3, and a display panel 4. Output signals from the source drive circuit 1 are supplied to the display panel 4 via source lines S1 through Sr, output signals from the gate drive circuit 3 are supplied to the display panel 4 via gate lines G1 through Gm, and display is performed at the display panel 4.

The display panel 4 may be, for example, a liquid crystal display panel, an organic EL (Electro Luminescence: electroluminescence) panel having OLED (Organic Light Emitting Diode: organic light-emitting diodes), or the like.

The display device 10 has the source drive circuit 1 where the settling time (stabilization time) has been shortened as described above, so insufficient gradients in display, display noise, uneven display, and so forth, can be suppressed.

Second Embodiment

A second embodiment of the present invention will be described with reference to FIG. 3. For the sake of convenience, members having the same functions as the members described in the first embodiment above are denoted with the same symbols, and description thereof will not be repeated.

Figure 3:
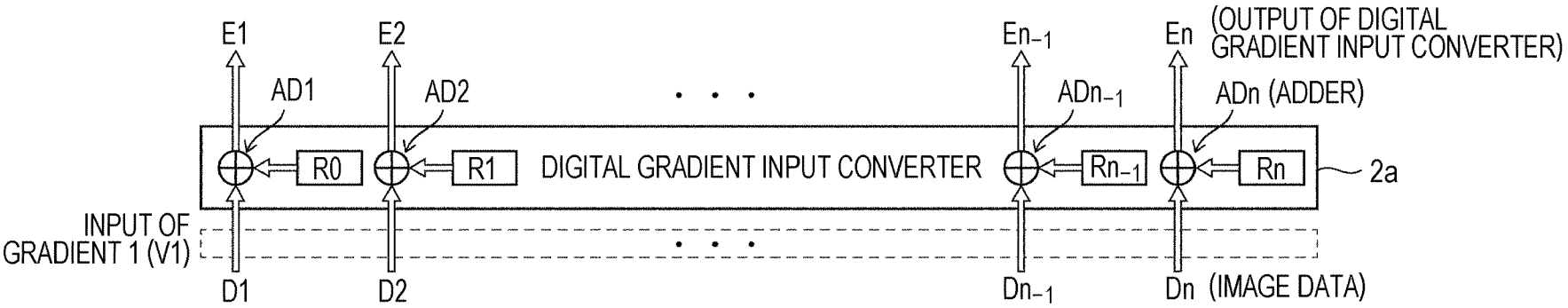
FIG. 3 is a diagram illustrating a digital gradient input converter provided to a source drive circuit according to a second embodiment of the present invention.

FIG. 3 is a diagram illustrating a digital gradient input converter 2*a* provided to a source drive circuit according to the second embodiment.

As illustrated in FIG. 3, the digital gradient input converter 2*a* (gradient input converter) has multiple registers R0, R1 . . . Rn.

Appropriately setting the multiple registers R0, R1 . . . Rn to the respective setting values, and providing adders AD1 through ADn, enables the adjustment values that decide the magnitude of conversion of the multiple gradient values of the multiple image data D1 through Dn to be, for example, 0, −1. +1 . . . in order from the left edge in the drawing, at the digital gradient input converter 2*a*, in the same way as in the first embodiment described above.

That is to say, the setting value of a register that needs an adjustment value of 0, the setting value of a register that needs an adjustment value of +1, and the setting value of a register that needs an adjustment value of −1, are each different. Note that the setting value of a register that needs an adjustment value of −1 can be applied with a two's complement of the setting value of a register that needs an adjustment value of +1.

Outputs E1 through En of the digital gradient input converter 2*a* are gradient values obtained by the gradient values of each of the image data D1 through Dn being added with the adjustment values defined by the setting values of each of the registers R0, R1 . . . Rn by each of the adders AD1 through ADn.

Note that in this embodiment as well, consideration needs to be given so that adjustment values are not applied in a case where the gradient values of the image data D1 through Dn are near gradient 0 which is near the smallest gradient value, since this would result in underflow of gradient values, and so that adjustment values are not applied in a case where the gradient values of the image data D1 through Dn are near gradient 255 which is near the greatest gradient value, since this would result in overflow of gradient values, in the same way as in the first embodiment.

Accordingly, in the present embodiment, an arrangement may be made where, in a case where the gradient values obtained by the gradient values of each of the image data D1 through Dn being added with adjustment values defined by the setting values of each of the registers R0, R1 . . . Rn, fall below gradient 0 or exceed gradient 255, the gradient values of the input image data D1 through Dn are output without change, or an arrangement may be made of fixing to gradient 0 in a case of falling below gradient 0 and fixing to gradient 255 in a case of exceeding gradient 255, as measures to deal with underflow of gradient values and overflow of gradient values.

The load on a particular reference power source bus line can be suppressed from being great in the source drive circuit having the digital gradient input converter 2*a*, so settling time (stabilization time) can be shortened.

Note that in the present embodiment, an example has been described regarding where one adder AD1 through ADn and one register R0, R1 . . . Rn is provided for one image data D1 through Dn in the digital gradient input converter 2*a*, as illustrated in FIG. 3, but this is not restrictive, and a configuration may be made where the number of adders and registers is only one to a few, that is smaller than the number of input image data D1 through Dn, with the input image data D1 through Dn being each sequentially processed, for example.

Third Embodiment

A third embodiment of the present invention will be described with reference to FIG. 4 and FIG. 5. For the sake of convenience, members having the same functions as the members described in the first embodiment above are denoted with the same symbols, and description thereof will not be repeated.

Figure 4:
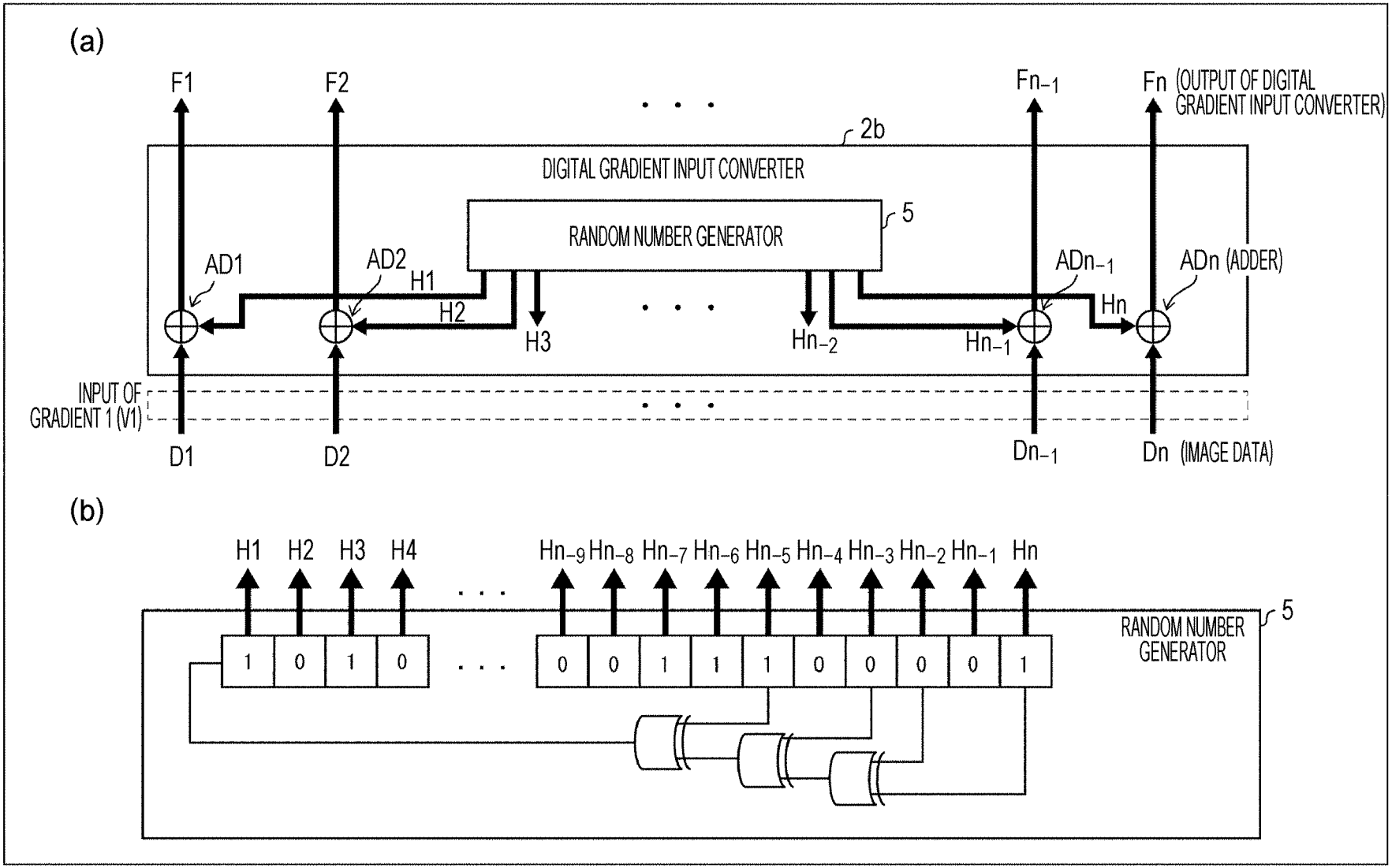
FIG. 4(*a*) is a diagram illustrating a digital gradient input converter provided to a source drive circuit according to a third embodiment of the present invention, and (*b*) is a diagram illustrating a random number generator provided to the digital gradient input converter.

(a) in FIG. 4 is a diagram illustrating a digital gradient input converter 2*b* provided to a source drive circuit according to the third embodiment, and FIG. 4(*b*) is a diagram illustrating a random number generator 5 provided to the digital gradient input converter 2*b*.

1s and 0s, that are 1-bit random numbers generated at the random number generator 5, are output from outputs H1 through Hn of the random number generator 5 as illustrated in (b) in FIG. 4. Although an example will be described in the present embodiment regarding a case where 1-bit random numbers are used, this is not restrictive.

The digital gradient input converter 2*b* has the random number generator 5 and adders AD1 through ADn as illustrated in (a) in FIG. 4, with the i-bit random numbers output from the respective outputs H1 through Hn of the random number generator 5 being supplied to each of the adders AD1 through ADn.

Note that although an example is described in the present embodiment regarding an example where the digital gradient input converter 2*b* is provided with one adders AD1 through ADn and one random number generator 5 output H1 through Hn for one image data D1 through Dn, as illustrated in (a) in FIG. 4, this is not restrictive, and a configuration may be made where the number of adders and outputs of the random number generator 5 is only one to a few, that is smaller than the number of input image data D1 through Dn, with the input image data D1 through Dn being each sequentially processed.

Outputs F1 through Fn of the digital gradient input converter 2*b* are gradient values obtained by the gradient values of each of the image data D1 through Dn being added with the 1-bit random numbers output from the respective outputs H1 through Hn of the random number generator 5 by each of the adders AD1 through ADn.

Note that the digital gradient input converter 2*b* uses 1-bit random numbers, so the adjustment values that decide the magnitude of conversion of the multiple gradient values of the multiple image data D1 through Dn are 0 and +1, but this is not restrictive, and for example, the breadth of adjustment values can be widened by using 2-bit random numbers.

Also, the digital gradient input converter 2*b* uses random numbers and accordingly the configuration is one where the above adjustment values are not fixed for each of the multiple source amps AM1 through AMn (omitted from illustration) corresponding to each of the multiple image data D1 through Dn.

Note that in this embodiment as well, consideration needs to be given so that adjustment values are not applied in a case where the gradient values of the image data D1 through Dn are near gradient 0 which is near the smallest gradient value, since this would result in underflow of gradient values, and so that adjustment values are not applied in a case where the gradient values of the image data D1 through Dn are near gradient 255 which is near the greatest gradient value, since this would result in overflow of gradient values, in the same way as in the first embodiment.

Accordingly, in the present embodiment, an arrangement may be made where, in a case where the gradient values obtained by the gradient values of each of the image data D1 through Dn being added with the outputs H1 through Hn of the random number generator 5, fall below gradient 0 or exceed gradient 255, the gradient values of the input image data D1 through Dn are output without change, or an arrangement may be made of fixing to gradient 0 in a case of falling below gradient 0 and fixing to gradient 255 in a case of exceeding gradient 255, as measures to deal with underflow of gradient values and overflow of gradient values.

The load on a particular reference power source bus line can be suppressed from being great in the source drive circuit having the digital gradient input converter 2*b*, so settling time (stabilization time) can be shortened.

Figure 5:
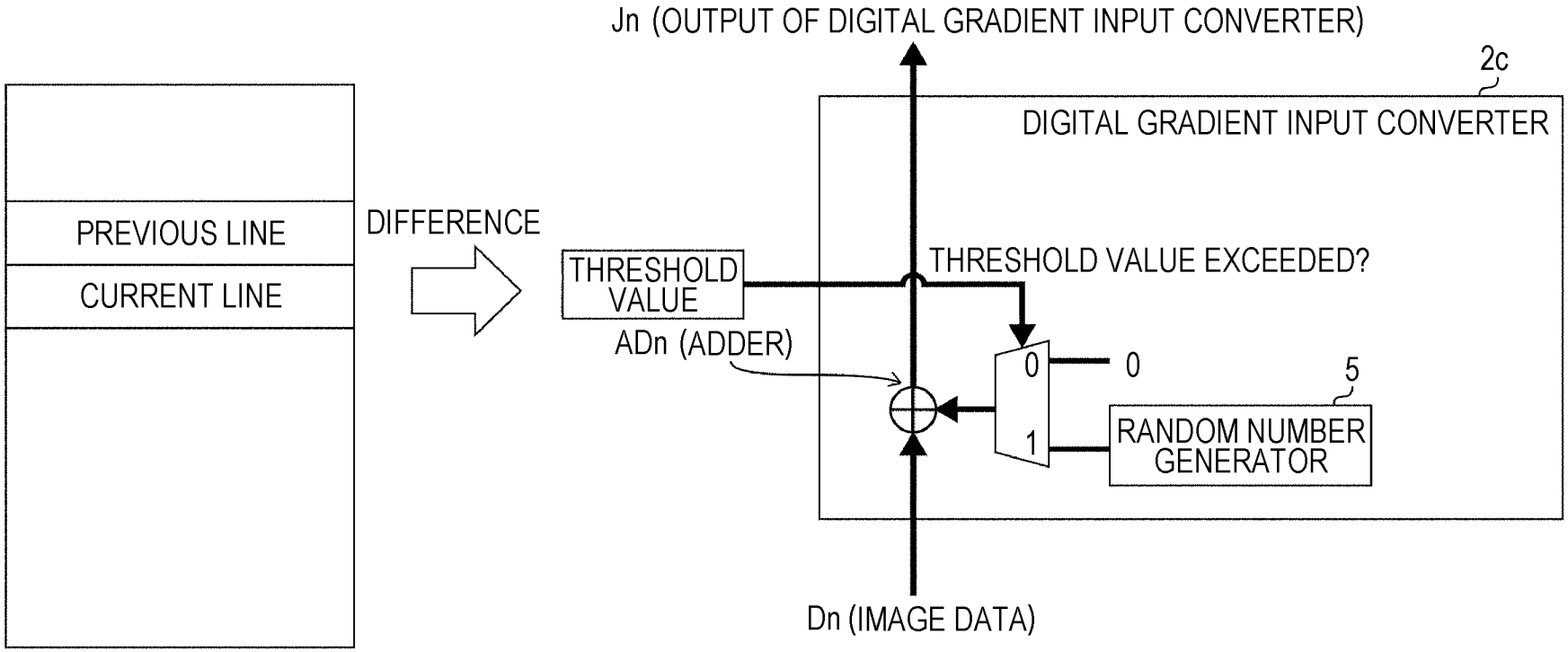
FIG. 5 is a diagram illustrating a digital gradient input converter provided to another source drive circuit according to the third embodiment of the present invention.

FIG. 5 is a diagram illustrating a digital gradient input converter 2*c* provided to another source drive circuit according to the third embodiment.

In the case of the above-described digital gradient input converter 2*b*, the configuration is such that random numbers output from the random number generator 5 are always applied as adjustment values for each of all image data D1 through Dn, regardless of the type of the image data D1 through Dn, but in the case of the digital gradient input converter 2*c* illustrated in FIG. 5, the configuration is such that random numbers output from the random number-generator 5 are applied as adjustment values only in a case where certain conditions are satisfied.

In the digital gradient input converter 2*c*, the configuration is such that the certain conditions are that the difference in display gradient is checked between the previous line and the current line, and whether or not to apply random numbers output from the random number generator 5 as adjustment values is decided based on the results thereof, as illustrated in FIG. 5.

Checking the difference in gradient ( ) gradient value between the previous line and the current line enables the magnitude in potential change among lines to be checked. For example, a certain threshold value may be decided, within random numbers output from the random number generator 5 being applied as adjustment values in a case where the difference in gradients exceeds the threshold value, and adjustment is not performed in a case of not exceeding the threshold value, which is to say that 0 is applied as an adjustment value. It is more preferable for the above threshold value to be settable to an optional value.

According to the above configuration in a case where the different in gradients is small, the input gradient can be output without change.

Note that examples of checking the difference in gradient (gradient value) between the previous line an current line include, for example, a method of obtaining the difference between the same source output for each data, a method where the difference is obtained between average values of the entire line or each predetermined region, but this is not restrictive.

The load on a particular reference power source bus line can be suppressed from being great in the source drive circuit having the digital gradient input converter 2*c* when particular image data, regarding which the load on a particular reference power source bus line can be predicted to be great, has been input, so settling time (stabilization time) can be shortened.

Fourth Embodiment

A fourth embodiment of the present invention will be described with reference to FIG. 6. For the sake of convenience, members having the same functions as the members described in the first embodiment above are denoted with the same symbols, and description thereof will not be repeated.

Figure 6:
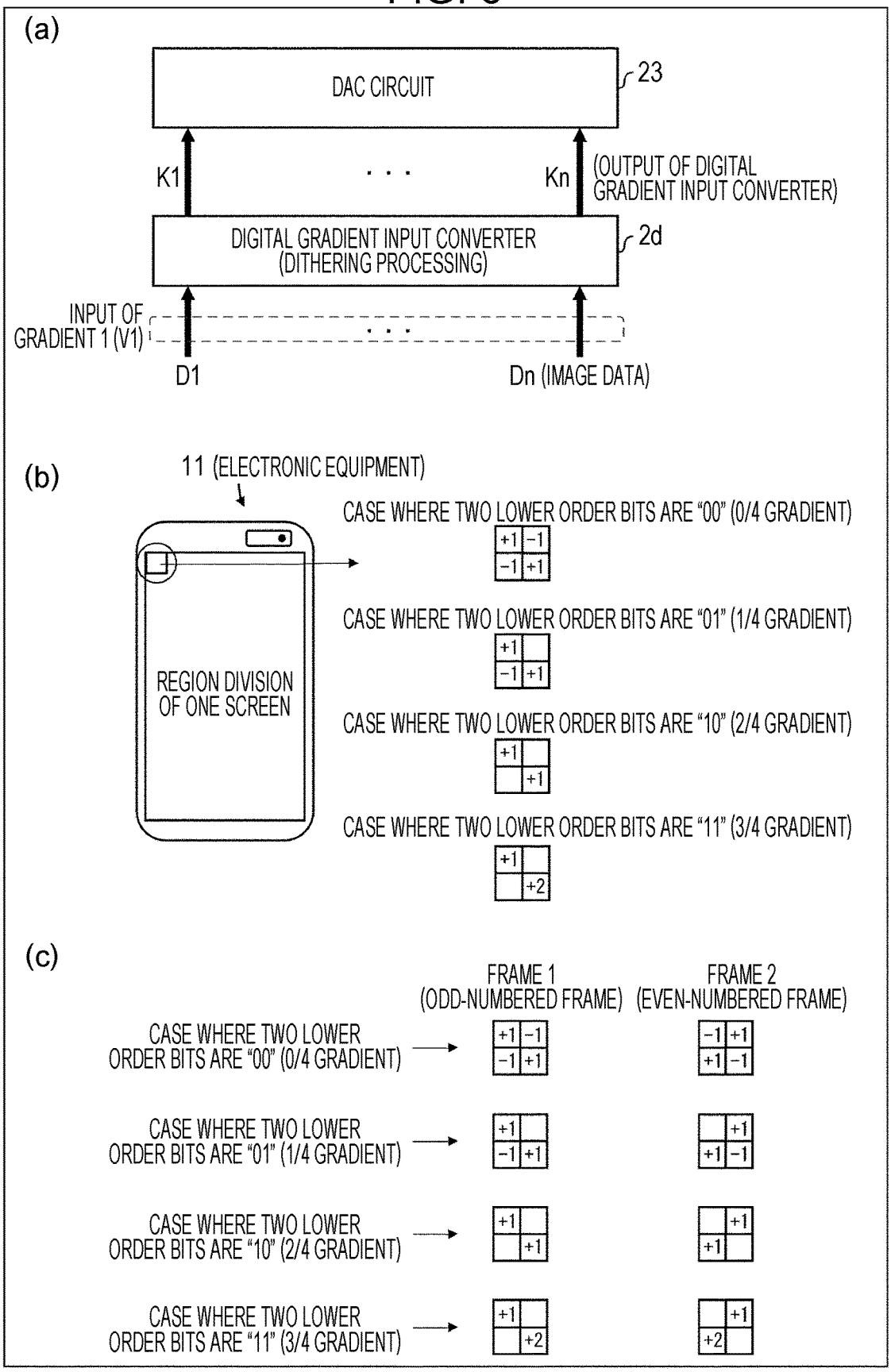
FIG. 6(*a*) is a diagram illustrating a digital gradient input converter and DAC circuit provided to a source drive circuit according to a fourth embodiment of the present invention, (*b*) is a diagram illustrating an example of dithering processing performed at the digital gradient input converter, and (*c*) is a diagram illustrating another example of dithering processing performed at the digital gradient input converter.

(a) in FIG. 6 is a diagram illustrating a digital gradient input converter 2*d* provided to a source drive circuit and DAC circuit 23 according to the fourth embodiment. FIG. 6(*b*) is a diagram illustrating an example of dithering processing performed at the digital gradient input converter 2*d*, and (*c*) in FIG. 6 is a diagram illustrating another example of dithering processing performed at the digital gradient input converter 2*d*.

Dithering processing is performed at the digital gradient input converter 2*d* illustrated in (a) in FIG. 6.

Dithering processing means a technique where slight (artificial) noise is intentionally applied to input gradient data, thereby smoothing boundary portions and suppressing cyclicity of error or the like.

Performing such dithering processing yields effects that quasi-gradients appear to the human eye, as compared with simple image processing like rounding (rounding up, rounding down, rounding off), for example.

While there are various techniques for selecting gradients and layouts in dithering processing, these will not be described in detail here.

The load on a particular reference power source bus line can be suppressed from being great in the present embodiment by applying the digital gradient input converter 2*d* that performs dithering processing, and visually good image quality can be obtained as well.

An example of dithering processing that can be performed at the digital gradient input converter 2*d* will be described below with reference to FIGS. 6(*b*) and (*c*) in FIG. 6. One screen displaying one image on a display panel of electronic equipment 11 such as a smartphone having a display device or the like, is divided into regions that are 2×2 pixel regions, for example, as illustrated in FIG. 6(*b*). Gradient values of one image data D1 through Dn are given to each 2×2 pixel region.

Four types of noise corresponding to the lower order two bits of one image data D1 through Dn are set beforehand in the digital gradient input converter 2*d*, and noise corresponding to these settings is added to the gradient values of the image data D1 through Dn.

That is to say, the relevant position values of a 2×2 filter are applied in accordance with the X coordinates (even or odd) and Y coordinates (even or odd) in the 2×2 pixel region. At this time, the lower order two bits of the gradient values of the image data D1 through Dn are deleted, and the values +1, −1, or the like, of the relevant positions are added to the remaining higher order bits. For example, as illustrated in FIG. 6(*b*), in a case where the lower order two bits of one image data D1 through Dn are "00" (0/4 gradient), dithering processing of +1, −1, +1, −1 is performed in the 2×2 pixel region, in a case where the lower order two bits are "01" (1/4 gradient), dithering processing of +1, 0 (omitted from illustration), +1, −1 is performed in the 2×2 pixel region, in a case where the lower order two bits are "10" (2/4 gradient), dithering processing of +1, 0 (omitted from illustration), +1, 0 (omitted from illustration) is performed in the 2×2 pixel region, and in a case where the lower order two bits are "11" (3/4 gradient), dithering processing of +1, 0 (omitted from illustration), +2, 0 (omitted from illustration) is performed in the 2×2 pixel region. In this case, the adjustment values are +2, +1, −1. Thus, the digital gradient input converter 2*d* supplies, to the DAC circuit 23, outputs K1 through Kn after dithering processing, where adjustment values that are values of relevant positions in the 2×2 filter has been added to gradient values of the image data D1 through Dn. The load on a particular reference power source bus line can be suppressed from becoming great due to the dithering processing such as illustrated in FIG. 6(*b*), and visually good image quality can be obtained as well.

Also, dithering processing may be performed by the digital gradient input converter 2*d* with different noise being applied to odd-numbered frames and even-numbered frames, as illustrated in (c) in FIG. 6. This sort of dithering processing enables noise to be applied in the time direction as well, and even higher quality noise can be accurately added.

Due to the dithering processing of applying different noise between odd frames and even frames, the load on a particular reference power source bus line can be suppressed from becoming great, and also visual compensation in the time direction (display of multiple frames) 0 regarding a gradient which is desired to be expressed, so results that are even better visually than the dithering processing illustrated in FIG. 6(*b*) can be obtained.

Note that in this embodiment as well, consideration needs to be given so that adjustment values are not applied in a case where the gradient values of the image data D1 through Dn are near gradient 0 which is near the smallest gradient value, since this would result in underflow of gradient values, and so that adjustment values are not applied in a case where the gradient values of the image data D1 through Dn are near gradient 255 which is near the greatest gradient value, since this would result in overflow of gradient values, in the same way as in the first embodiment.

Accordingly, in the present embodiment, an arrangement may be made as measures against underflow of gradient values and against overflow of gradient values where, in a case where the gradient values of the outputs K1 through Kn of the digital gradient input converter 2*d* fall below gradient 0 or exceed gradient 255, the gradient values of the input image data D1 through Dn are output without change, or an arrangement may be made of fixing to gradient 0 in a case of falling below gradient 0 and fixing to gradient 255 in a case of exceeding gradient 255.

The present invention is not restricted to the above-described embodiments. Various modifications may be made within the scope set forth in the claims, and embodiments obtained by appropriately combining technical means disclosed in each of different embodiments are also included in the technical scope of the present invention. Further, new technical features can be formed by combining technical means disclosed in the embodiments.

REFERENCE SIGNS LIST

1 source drive circuit (drive circuit)
2, 2*a*, 2*c*, 2*d* digital gradient input converter (gradient input converter)
3 gate drive circuit
4 display panel
5 random number generator
10 display device
11 electronic equipment
23 DAC circuit (digital/analog conversion circuit)
24 gamma circuit (gradient reference voltage generating circuit)
25 demultiplexer
D1 through Dn image data
H1 through Hn output of random number generator
AM1 through AMn source amp
AD1 through ADn adder
E1 through En output of digital gradient input converter
F1 through Fn output of digital gradient input converter
Jn output of digital gradient input converter
Q1 through Qn output node of source amp
U1 through Un input node of source amp BL1 through BL256 reference power source bus line
S1 through Sr source line
G1 through Gm gate line
V0 through V255 gradient reference voltage

The invention claimed is:

1. A display device comprising:

a display panel;

a plurality of source amps that supply output signals to corresponding ones of a plurality of source lines of the display panel;

a gamma circuit that generates M (where M is a natural number of 2 or greater) different gradient reference voltages;

a digital/analog conversion circuit that selects one of the M gradient reference voltages supplied from the gamma circuit via each of M bus lines, based on each of input gradient values, and supplies to each of the plurality of source amps; and a digital gradient input converter that converts the plurality of gradient values of a plurality of image data that are the same value into two or more gradient values that are mutually different values, and supplies to the digital/analog conversion circuit.

2. The display device according to claim 1, wherein the digital gradient input converter converts part of the plurality of gradient values of a plurality of image data that are the same value to a gradient value that is one higher or a gradient value that is one lower.

3. The display device according to claim 1, wherein the digital gradient input converter performs the conversion only in a first case where the plurality of gradient values of a plurality of image data that are the same value are a gradient value that is N (where N is a natural number of 1 or greater and 3 and smaller) below a greatest gradient value or greater, or the greatest gradient value or smaller, and in a second case where the plurality of gradient values of a plurality of image data that are the same value are a gradient value that is the smallest gradient value or greater, or N above a smallest gradient value or smaller.

4. The display device according to claim 1, wherein the digital gradient input converter only performs the conversion in a case where a difference between the plurality of gradient values of a plurality of image data that are the same value and a plurality of gradient values of a plurality of image data supplied immediately prior is a predetermined value or greater.

5. The display device according to claim 1, wherein an adjustment value for deciding a magnitude of conversion of the plurality of gradient values of a plurality of image data that are the same value is set in each of the plurality of source amps at the digital gradient input converter, and wherein, in a case where a value obtained by adding the adjustment value and the plurality of gradient values of a plurality of image data that are the same value is the smallest gradient value or greater and the greatest gradient value or smaller, each of the plurality of gradient values of a plurality of image data that are the same value is converted by an amount corresponding to the adjustment value.

6. The display device according to claim 1, wherein the digital gradient input converter has a plurality of registers, wherein an adjustment value for deciding the magnitude of conversion of the plurality of gradient values of a plurality of image data that are the same value is set by each of the setting values of the plurality of registers, and wherein, in a case where a value obtained by adding the adjustment value and the plurality of gradient values of a plurality of image data that are the same value is the smallest gradient value or greater and the greatest gradient value or smaller, each of the plurality of gradient values of a plurality of image data that are the same value is converted by an amount corresponding to the adjustment value.

7. The display device according to claim 1, wherein the digital gradient input converter has a random number generator, wherein an adjustment value for deciding the magnitude of conversion of the plurality of gradient values of a plurality of image data that are the same value is set by a random number generated by the random number generator, and wherein, in a case where a value obtained by adding the adjustment value and the plurality of gradient values of a plurality of image data that are the same value is the smallest gradient value or greater and the greatest gradient value or smaller, each of the plurality of gradient values of a plurality of image data that are the same value is converted by an amount corresponding to the adjustment value.

8. The display device according to claim 1, wherein an adjustment value for deciding the magnitude of conversion of the plurality of gradient values of a plurality of image data that are the same value is set by the digital gradient input converter performing dithering processing on each pixel region of a predetermined size configured of part of the plurality of pixels that display the plurality of image data, and wherein, in a case where a value obtained by adding the adjustment value and the plurality of gradient values of a plurality of image data that are the same value is the smallest gradient value or greater and the greatest gradient value or smaller, each of the plurality of gradient values of a plurality of image data that are the same value is converted by an amount corresponding to the adjustment value.

9. The display device according to claim 8, wherein the dithering processing includes first dithering processing that is dithering processing performed on image data of odd frames in the plurality of image data, and second dithering processing that is dithering processing performed on image data of even frames in the plurality of image data, wherein the first dithering processing and the second dithering processing are different.

10. The display device according to claim 5, wherein, at the digital gradient input converter, in a case where a value obtained by adding the adjustment value and the plurality of gradient values of a plurality of image data that are the same value is smaller than the smallest gradient value or greater than the greatest gradient value, each of the plurality of gradient values of a plurality of image data that are the same value is output without change, without being converted by an amount corresponding to the adjustment value.

11. The display device according to claim 5, wherein, at the digital gradient input converter, in a case where a value obtained by adding the adjustment value and the plurality of gradient values of a plurality of image data that are the same value is smaller than the smallest gradient value, the smallest gradient value is output, and wherein, in a case where a value obtained by adding the adjustment value and the plurality of gradient values of a plurality of image data that are the same value is greater than the greatest gradient value, the greatest gradient value is output.

* * * * *